US005338207A

United States Patent [19]

Lineberry et al.

[11] Patent Number: 5,338,207

[45] Date of Patent: Aug. 16, 1994

[54] MULTI-ROW RIGHT ANGLE CONNECTORS

[75] Inventors: Daniel C. Lineberry, Lexington; Warren A. Bates, Winston-Salem, both of N.C.

[73] Assignee: The Whitaker Corporation, Wilmington, Del.

[21] Appl. No.: 75,088

[22] Filed: Jun. 9, 1993

[51] Int. Cl.[5] ..... H01R 9/09

[52] U.S. Cl. ..... 439/62; 439/65; 439/67; 439/77

[58] Field of Search ..... 493/60, 62, 65, 67, 493/77, 493, 632, 637

[56] References Cited

U.S. PATENT DOCUMENTS

| | | | |
|---|---|---|---|
| 4,092,057 | 5/1978 | Walton | 439/67 |
| 4,552,420 | 11/1985 | Eigenbrode | 439/65 X |
| 5,171,154 | 12/1992 | Casciotti et al. | 439/67 |
| 5,227,593 | 1/1994 | Bates et al. | 439/77 X |

OTHER PUBLICATIONS

Connection and Interconnection Handbook vol. 2 pp. 4–26 to 4–30 published 1979.

*Primary Examiner*—Z. R. Bilinsky

[57] ABSTRACT

A zero insertion force ("ZIF") electrical connector for mating the card edge of a daughter-board (7) orthogonally with respect to the surface of a mother-board (5). The connector includes a stacked plurality of compressible electrical contacts (30-1 . . . n, 32-1 . . . n) separated by a plurality of insulating plates (40-1 . . . n, 42-1 . . . n). End caps (26) are anchored to the mother-board (5) and mount the compressible electrical contacts (30-1 . . . n, 32-1 . . . n) and insulating plates (40-1 . . . n, 42-1 . . . n) in a stacked array with each compressible electrical contact (30-1 . . . n, 32-1 . . . n) bridging the junction of the mother-board (5) and daughter-board (7). This way, the array of compressible electrical contacts (30-1 . . . n, 32-1 . . . n) cumulatively complete multiple rows of high-density electrical connections between the mother-board (5) and daughter-board (7).

10 Claims, 3 Drawing Sheets

MULTI-ROW RIGHT ANGLE CONNECTORS

FIELD OF THE INVENTION

The present invention relates to electrical connectors and, more particularly, to a zero insertion force ("ZIF") connector which allows orthogonal docking of a daughter board to a mother board.

BACKGROUND OF THE INVENTION

As electronic systems continue to increase in density and operating speeds, severe electrical and mechanical demands are placed on the electrical connectors employed in the systems. The connectors must complete numerous high density electrical connections, yet they must be rugged and versatile and must comply with high-speed signal specifications.

FIGS. 1 and 3 illustrate an existing solution for the right angle interconnection of a mother-board and daughter-board where FIG. 3 is an enlarged partial, exploded perspective view of the assembly of FIG. 2. FIG. 1 is a perspective drawing and FIG. 2 an exploded drawing of an AMP-ASC® interconnection system which is commercially available from AMP Incorporated of Harrisburg, Pennsylvania. The AMP-ASC Interconnection System uses an innovative contact technology and support structure to provide a board-to-board connector that is higher density and can carry faster signals than conventional connectors. The illustrated connector is an AMP-ASC mother-board to daughter-board card-edge connector, and it is obviously made with a very small number of parts. As seen in the enlarged view of FIG. 3, canted coil springs 10 are seated in rigid metal core members 12, and core members 12 are then wrapped by a flexible etched circuit 14 to hold the canted coil springs 10 in place. Two such modules 2 are held side-by-side by plastic end caps 16. The completed assembly is mounted on a mother-board 5. The canted coil springs 10 provide high compliancy and nearly constant normal force through a wide range of deflection. Tightening the modules 2 against the mother-board 5 completes the appropriate electrical connections with the flexible etched circuit 14. Photolithographic fabrication of the flexible etched circuit allows routing of the appropriate conductive traces between the mother-board 5 and daughter-board 7. Hence, insertion of a daughter-board 7 between the two modules 2 compresses the canted coil springs 10 and completes the interconnection between the daughter-board 7 and the mother-board 5 via the flexible etched circuit. This and other AMP-ASC interconnection systems 10 can provide high fidelity interconnection of signals with rise-times of less than 0.3 nanoseconds and at densities up to 160 signal lines per inch.

However, there is ample room for improvement. The assembly and disassembly time of the above-described components (for servicing) is still excessive. More importantly, the manufacturing costs of the canted coil springs 10 are high.

For these reasons, there have been efforts at refining the canted coil springs 10. AMP Incorporated provides an alternative in the form of its AMPLIFLEX® compressible contacts. These AMPLIFLEX® compressible contacts include a flexible etched circuit having plurality of closely-spaced traces photographically etched or otherwise formed on a flexible film. The flexible etched circuit is wrapped around an elongate elastomeric core and is bonded thereto. The elastomeric core eliminates the need for the canted coil springs 10 and intricate molded core members 12 of FIG. 2. Consequently, AMPLIFLEX® compressible contacts are far less expensive to manufacture.

For this reason, it would be greatly advantageous to incorporate AMPLIFLEX® compressible contact technology in a right-angle zero insertion force connector of the type described in FIGS. 1 and 2.

SUMMARY OF THE INVENTION

It is, therefore, an object of the present invention to provide a right-angle zero insertion force ("ZIF") card edge connector which allows orthogonal docking of a daughter board to a mother board with a minimum of cooperating parts.

It is another object of the invention to incorporate AMPLIFLEX® compressible contact technology in a right-angle ZIF connector to minimize manufacturing costs and to facilitate assembly and disassembly.

It is still another object to provide a right-angle ZIF connector as described above in which the components used and the sequence of assemblage results in precision alignment and interconnection of the contact pads/-traces on the orthogonal mother-board and daughter-board.

In accordance with the above-described and other objects, the present invention provides an electrical connector for mating a card edge of a first circuit board to a surface of a second printed circuit board. The electrical connector comprises at least two compressible electrical contacts each having an elongate elastomeric core wrapped by a flexible circuit with a plurality of conductive traces etched thereon. The conductive traces are etched around each flexible circuit to form a high-density row of contacts when wrapped around the elastomeric core.

In addition, a plurality of flat insulating plates is provided to shield each of the compressible electrical contacts.

A plurality of end caps holds the compressible electrical contacts in a stacked array. The compressible electrical contacts are formed with progressively wider cross-sections which are arrayed in diagonal layers bridging the first and second circuit boards. Each compressible electrical contact is separated from the adjacent contacts by the insulating plates. The end caps are tightened against the second circuit board such that one side of all layered compressible electrical contacts are compressed thereagainst and the respective flexible circuits are biased into multiple rows of electrical contact with said second printed circuit board. The opposite sides of the compressible electrical contacts are held in array to allow slidable insertion of the first printed circuit board. When the first printed circuit board has been inserted, a corresponding number of rows of electrical contact is completed with it via the respective flexible circuits.

The connector of the present invention may include two sets of compressible electrical contacts and insulating plates bridging the two circuit boards on both sides of the intersection. This way, the connector can accommodate a multiple layer first circuit board with contact pads or traces located on opposite sides of the card edge.

Other advantages and results of the invention are apparent from a following detailed description by way of example of the invention and from the accompanying drawings.

BRIEF DESCRIPTION OF DRAWINGS

FIG. 5 is a cross-sectional view of the multi-row right angle connector of PIGS. 4 and 5.

DETAILED DESCRIPTION OF THE PREFERRED EMBODIMENT

Figure 1:
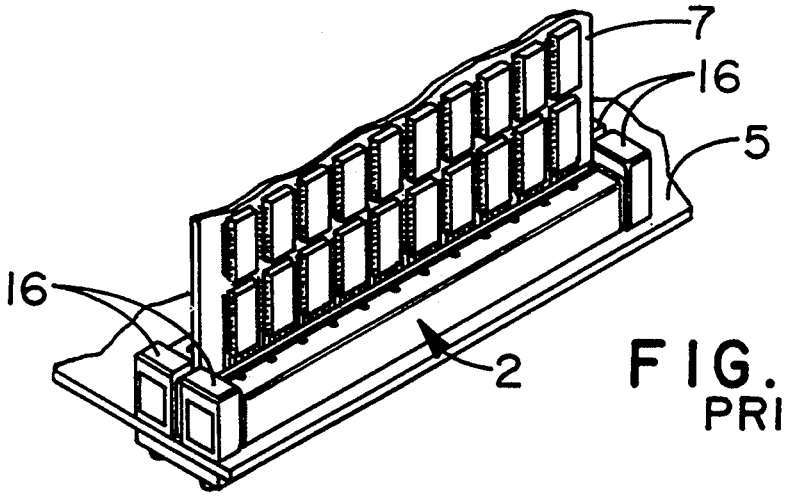
FIG. 1 PRIOR ART
FIGS. 1 and 2 illustrate a perspective view and an exploded view, respectively, of a PRIOR ART system, identified as an AMP-ASC® interconnection system which is commercially available from AMP Incorporated of Harrisburg, Pa.
Figure 2:
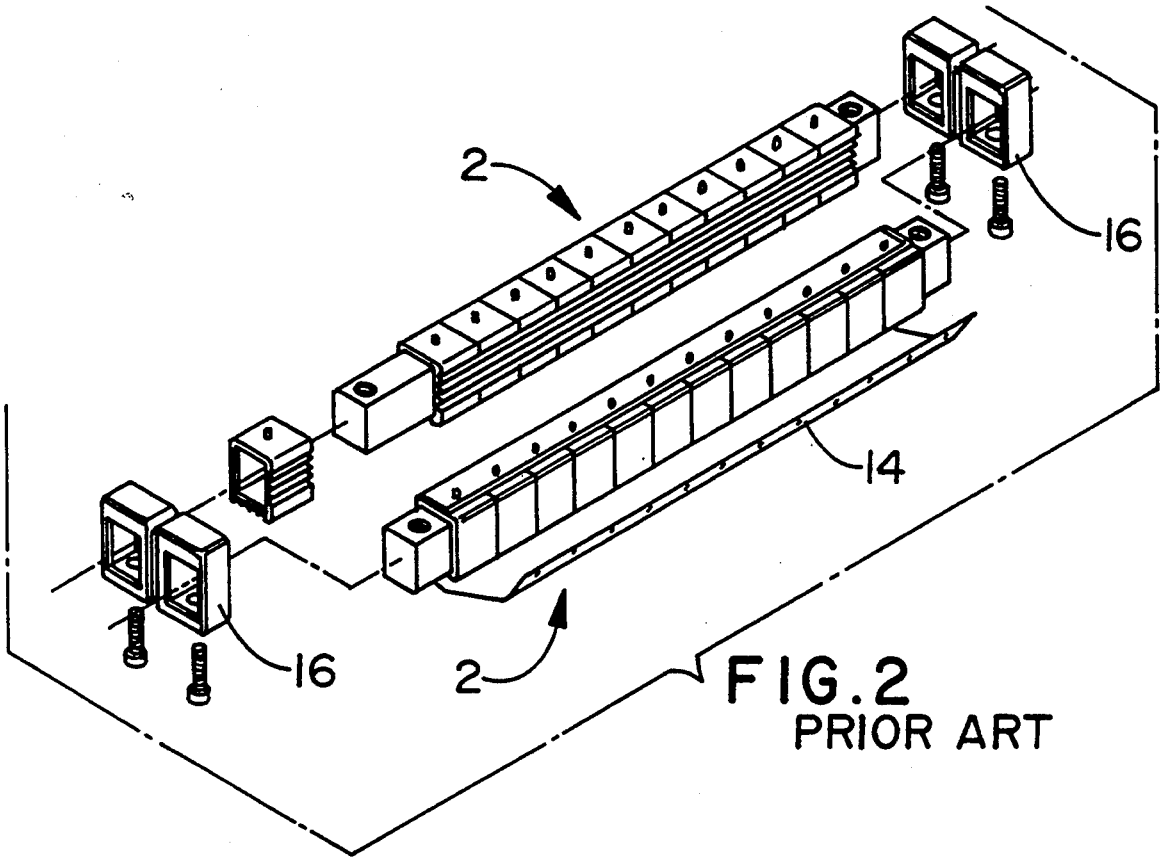
FIG. 2 PRIOR ART
Figure 3:
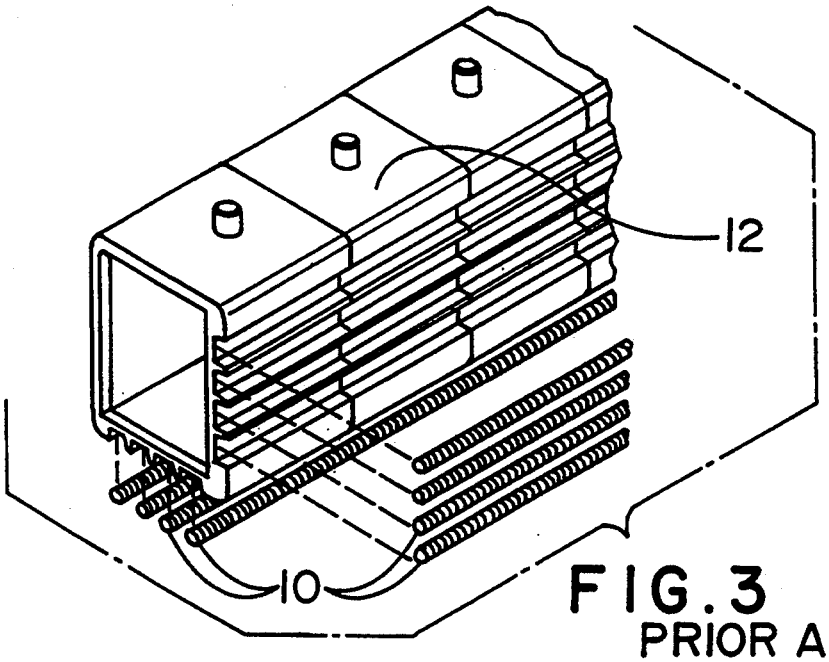
FIG. 3 PRIOR ART
FIG. 3 is an enlarged, partial, exploded perspective view of the assembly of FIG. 2 showing further the position and placement of the plural canted coil springs 10.
Figure 4:
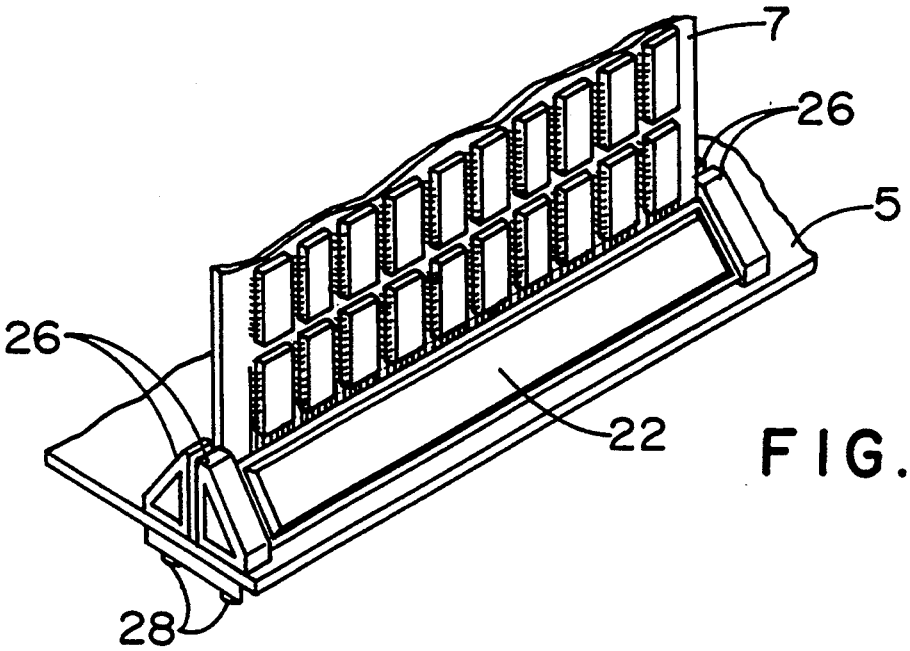
FIG. 4 is a perspective view of a multi-row right angle connector according to the present invention.

With more particular reference to the drawings, FIG. 4 is a perspective view of a multi-row right angle ZIF connector according to the present invention.

The connector embodiment shown in FIG. 4 is capable of completing multiple electrical connections from a mother-board 5 to both sides of the card edge of a daughter-board 7 inserted orthogonally or at any other angle. However, it should be understood that the invention may be practiced in the form of a single-sided embodiment for connecting mother-board 5 to only one side of the daughter-board 7.

In the illustrated two-sided arrangement, two connector modules 22 are held side-by-side by a pair of plastic end caps 26, and the end caps are secured to the mother-board 5 via screws 28 to likewise anchor the modules 22. Alternatively, rivets, heat-staked posts, glue or the like may be used to secure the end caps 26. Each end cap 26 may be formed as shown to seat one end of both connector modules 22. Alternatively, four separate end caps 26 may be provided for separately seating the ends of each connector module 22. In any case, the end caps 26 are formed with a slot at their apex, and the connector modules 22 are appropriately spaced for receiving and guiding slidable insertion of the card edge of a daughter-board 7.

Figure 5:
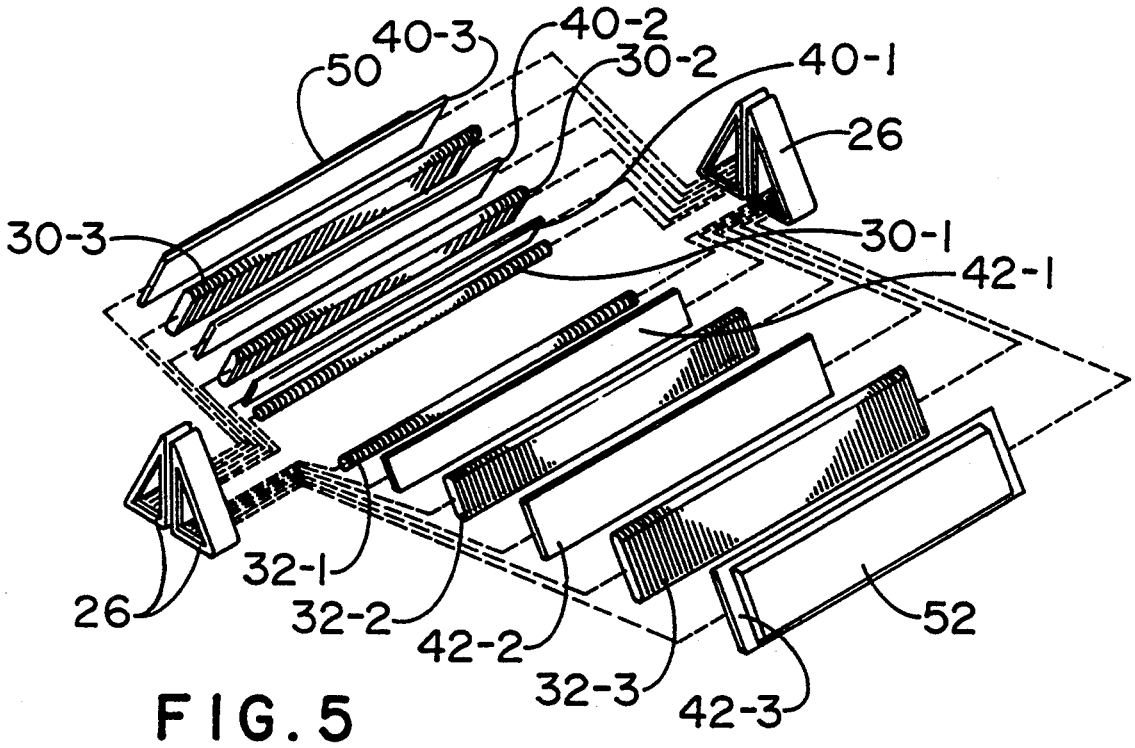
FIG. 5 is an exploded view of the multi-row right angle connector of FIG. 4.

FIG. 5 is an exploded view of the multi-row ZIF connector of FIG. 4. As shown in FIG. 4, each connector module 22 further comprises a stacked array of compressible electrical contacts (30-1 . . . 3, 32-1 . . . 3) of outwardly increasing width and a corresponding number of insulating plates (40-1 . . . 3, 42-1 . . . 3) separating the adjacent compressible electrical contacts (30-1 . . . 3, 32-1 . . . 3). It should be apparent that any number of compressible electrical contacts (30-1 . . . n, 32-1 . . . n) can be stacked with an equal number of insulating plates (40-1 . . . n, 42-1 . . . n) to achieve the necessary number of connections.

The insulating plates (40-1 . . . 3, 42-1 . . . 3) may be formed in elongate rectangular sheets of plastic or other insulating composite, and one plate is sandwiched between each pair of adjacent compressible electrical contacts (30-1 . . . 3, 32-1 . . . 3). As with the compressible electrical contacts (30-1 . . . 3, 32-1 . . . 3), the insulating plates (40-1 . . . 3, 42-1 . . . 3) of each module 22 are formed with outwardly increasing widths, and the widths are such that all insulating plates (40-1 . . . 3, 42-1 . . . 3) fully bridge the right-angle junction between the mother-board 5 and daughter-board 7. This insures that adjacent compressible contacts (30-1 . . . 3, 32-1 . . . 3) are properly isolated.

The outermost insulating plate 40-3 and 42-3 on each side of the daughter-board 7 is preferably formed with a raised cross-section 50, 52 or other reinforcing structure to resist the outward resiliency of the compressible contacts (30-1 . . . 3, 32-1 . . . 3).

Compressible contacts (30-1 . . . 3, 32-1 . . . 3) each include an elongate elastomeric core member wrapped by a flexible circuit. The flexible circuit is provided with a plurality of outwardly exposed and closely-spaced conductive traces which may be photographically etched or otherwise formed on a conventional flexible film. The flexible film is bonded or otherwise secured around the elastomeric core such that the conductive traces form a high-density array of contacts spaced lengthwise. A variety of such compressible contacts is commercially available from AMP Incorporated of Harrisburg, Pa. under the trademark "AMPLI-FLEX®." The compressible contacts (30-1 . . . 3, 32-1 . . . 3) of the present invention differ only insofar as their shapes. The compressible contacts (30-1 . . . 3, 32-1 . . . 3) stacked within each connector module 22 are formed incremental widths such that each one completely bridges the right-angle junction between the mother-board 5 and daughter-board 7.

Figure 6:
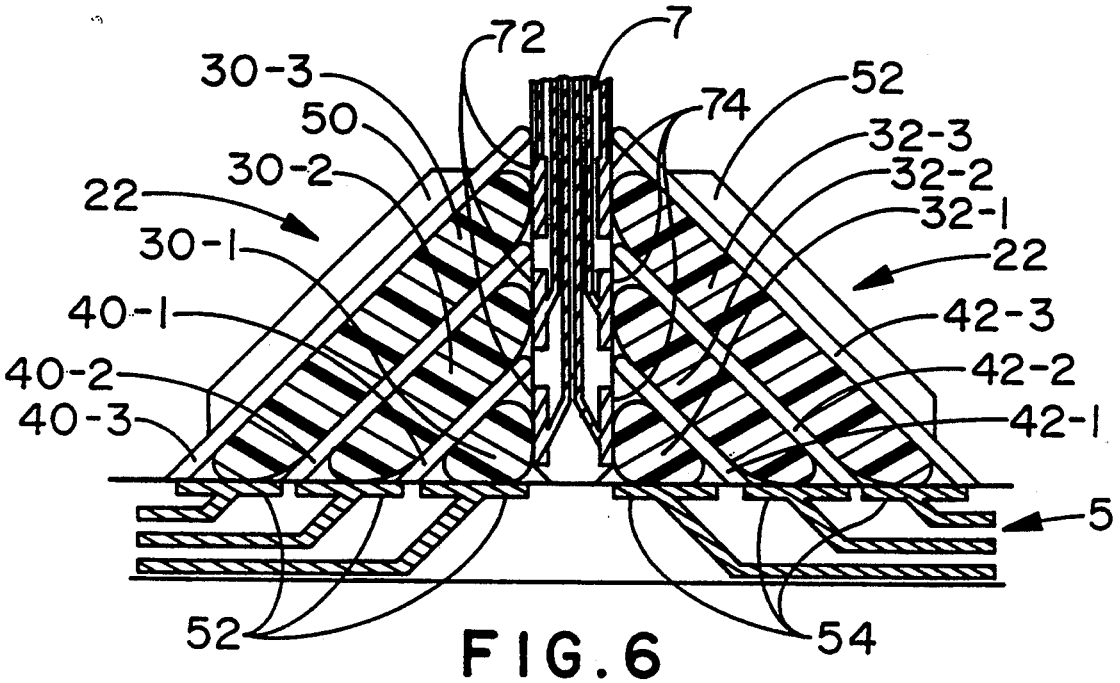

The operation of the above-described multi-row right angle connector of FIGS. 4 and 5 will now be described with reference to FIG. 6, which is a cross-sectional view. As seen in FIG. 6, the opposing connector modules 22 are spaced such that the compressible electrical contacts (30-1 . . . 3, 32-1 . . . 3) and insulating plates (40-1 . . . 3, 42-1 . . . 3) are diagonally stacked in two opposing arrays on the two sides of the daughter-board 7. The widths of the compressible electrical contacts (30-1 . . . 3, 32-1 . . . 3) and insulating plates (40-1 . . . 3, 42-1 . . . 3) increase from the junction of the mother-board 5 and daughter-board 7 outward in order that each will completely bridge the two circuit boards 5 and 7.

When the end caps 26 are secured to the mother-board 5, the sides of the compressible contacts (30-1 . . . 3, 32-1 . . . 3) abutting the mother-board 5 are held in compression against the mother-board 5, and the conductive traces on the respective compressible contacts (30-1 . . . 3, 32-1 . . . 3) are electrically connected to the appropriate traces and/or contact pads (52, 54) on the mother-board 5. The stacked array of compressible contacts (30-1 . . . 3, 32-1 . . . 3) establish multiple rows of electrical connections along the mother-board 5, and numerous close-pitch individual connections are completed within each row.

Similarly, when the daughter-board 7 is fully inserted, the other sides of the compressible contacts (30-1 . . . 3, 32-1 . . . 3) abutting the daughter-board 7 are held in compression against the daughter-board 7, and the conductive traces on the respective compressible contacts (30-1 . . . 3, 32-1 . . . 3) are electrically connected to the appropriate traces and/or contact pads (72, 74) on the daughter-board 7. Again, the stacked array of compressible contacts (30-1 . . . 3, 32-1 . . . 3) cumulatively establish multiple rows of electrical contact along the daughter-board 7, and numerous close-pitch individual connections are completed within each row.

The resiliency of the elastomeric cores in the compressible contacts (30-1 . . . 3, 32-1 . . . 3) biases the flexible circuit against both boards 5 and 7 and maintains reliable electrical contact therewith.

The appropriate photolithographic fabrication of the flexible circuit around each compressible contact (30-1 . . . 3, 32-1 . . . 3) assures the proper routing of signals between the mother-board 5 and daughter-board 7. The result is a sturdy, reliable and extremely high-density ZIF connector which enables signals with rise-times of less than 0.3 nanoseconds.

We claim:

1. An electrical connector for mating the card edge of a first circuit board to a planar surface of a second printed circuit board, said electrical connector comprising:

at least two compressible electrical contacts of increasing width, said compressible electrical contacts each further including an elongated elastomeric core wrapped by a flexible circuit having a plurality of conductive traces thereon to form a row of contacts;

a plurality of insulating plates each adjacent to a corresponding one of said compressible electrical contacts for shielding thereof; and a plurality of end caps anchored to said planar surface of the second circuit board for mounting said compressible electrical contacts in stacked layers separated by said insulating plates, each compressible contact bridging said first and second circuit boards with one side held in compression against said second circuit board to bias the flexible circuit thereagainst, said stacked compressible electrical contacts cumulatively establishing multiple rows of electrical contact with said second printed circuit board, and another side of said compressible electrical contacts being held in array for slidable insertion of said first printed circuit board to thereby establish a corresponding number of rows of electrical contact therewith via said conductive traces on said flexible circuits.

2. The electrical connector according to claim 1 wherein said at least two compressible electrical contacts further comprises three compressible electrical contacts.

3. The electrical connector according to claim 1 wherein each of said plurality of insulating plates diagonally bridge said first and second circuit board for shielding said compressible electrical contacts, and an outermost one of said insulating plates is formed with a reinforced cross-section to withstand the outward compression of the compressible contacts enclosed thereby.

4. The electrical connector according to claim 1 for orthogonally mating the card edge of said first circuit board relative to the second printed circuit board, whereby said end caps mount the compressible electrical contacts in diagonal layers which bridge the intersection of the first and second circuit boards.

5. The electrical connector according to claim 1 wherein said at least two compressible electrical contacts further comprise an inner compressible electrical contact of substantially oval cross-section and a wider outer compressible electrical contact arranged in diagonal layers both for bridging the intersection of the first and second circuit boards.

6. An electrical connector for mating both sides of a card edge of a first circuit board to a planar surface of a second printed circuit board, said electrical connector comprising:

a first plurality of compressible electrical contacts of increasing width, and a second plurality of compressible electrical contacts of increasing width, all of said compressible electrical contacts each further including an elongated elastomeric core wrapped by a flexible circuit having a plurality of conductive traces thereon to form a row of contacts;

a plurality of insulating plates each for shielding a corresponding one of said compressible electrical contacts; and a pair of end caps anchored to said planar surface of the second circuit board for mounting said first plurality of compressible electrical contacts in layers separated by said insulating plates and bridging one side of said first circuit board to the surface of the second circuit board, and for mounting said second plurality of compressible electrical contacts in layers separated by said insulating plates and bridging the opposite side of said first circuit board to the surface of the second circuit board, the flexible circuits of all of said compressible electrical contacts being held in compression against the surface of the second circuit board to cumulatively complete multiple rows of electrical contact therewith, and the other side of said first plurality of compressible electrical contacts being held in array a distance from the other side of the second plurality of compressible electrical contacts to form a slot therebetween for slidable insertion of said first printed circuit board, whereby a corresponding number of rows of electrical contact are established via the flexible circuits to both sides of the first printed circuit board.

7. The electrical connector according to claim 6 wherein said first plurality of compressible electrical contacts further comprises three compressible electrical contacts, and said second plurality of compressible electrical contacts further comprises a like plurality of contacts.

8. The electrical connector according to claim 6 wherein each of said plurality of insulating plates diagonally bridge said first and second circuit board for shielding said compressible electrical contacts, and an outermost pair of said insulating plates are formed with a reinforced cross-section to withstand the outward compression of the compressible contacts enclosed thereby.

9. The electrical connector according to claim 6 for orthogonally mating the card edge of said first circuit board relative to the second printed circuit board, whereby said end caps mount said first and second plurality of compressible electrical contacts in two opposing sets of diagonal layers, one set bridging the intersection of the first and second circuit boards on one side, and another set bridging the intersection of the first and second circuit boards on the other side.

10. The electrical connector according to claim 6 wherein said first plurality and second plurality of compressible electrical contacts each further comprise an inner compressible electrical contact of substantially oval cross-section and a wider outer compressible electrical contact arranged in diagonal layers for bridging the intersection of the first and second circuit boards on respective sides.

* * * * *